United States Patent [19]

Engel

[11] Patent Number: 5,068,498

[45] Date of Patent: Nov. 26, 1991

[54] JOYSTICK FOR MOUNTING ON DUAL-WIDTH PANELS

[75] Inventor: Raul R. Engel, Skokie, Ill.

[73] Assignee: Wico Distribution Corp., Niles, Ill.

[21] Appl. No.: 566,774

[22] Filed: Aug. 14, 1990

[51] Int. Cl.[5] ..... H01H 25/04

[52] U.S. Cl. ..... 200/6 A; 340/709; 74/471 XY

[58] Field of Search ..... 340/709; 74/471 XY; 200/6 A; 273/148 B; 29/234

[56] References Cited

U.S. PATENT DOCUMENTS

| | | | |
|---|---|---|---|
| 4,291,213 | 9/1981 | Felland et al. | 200/6 A |
| 4,470,320 | 9/1984 | Kim | 74/471 XY |
| 4,784,008 | 11/1988 | Paguereau et al. | 74/471 XY |
| 4,795,952 | 1/1989 | Brandstetter | 74/471 XY |

*Primary Examiner*—Jeffery A. Brier
*Assistant Examiner*—Jick Chin
*Attorney, Agent, or Firm*—Emrich & Dithmar

[57] ABSTRACT

The joystick can be mounted on a thin panel or a thick panel. The joystick comprises a frame and a shaft extending through the frame. The shaft has a large-diameter portion and a small-diameter portion. A handle is mounted on the free end of the large diameter portion and the smaller diameter portion is pivotally mounted to the frame. Actuating means on the smaller diameter portion selectively engages microswitches. A bushing is located on the free end of the small-diameter portion when the joystick is mounted on a thin panel and is mounted on the other end when the joystick is mounted on a thick panel.

14 Claims, 2 Drawing Sheets

JOYSTICK FOR MOUNTING ON DUAL-WIDTH PANELS

BACKGROUND OF THE INVENTION

This invention relates generally to joysticks and more particularly it relates to a joystick which can be mounted on a thin panel or a thick panel.

Video games incorporate various controls for the player to manipulate the image displayed on the video screen. One such control is a joystick. Usually the panel on which joysticks are mounted is either ⅛" or ¾" in thickness.

Joysticks commonly comprise a frame, a shaft pivotally mounted on the frame, an actuator carried by the shaft at one end thereof, a set of microswitches which are selectively engaged by the actuator, and a handle at the outer end of the joystick. The player grasps the handle and pivots the joystick to selectively close and open the switches.

Presently available joysticks cannot be modified to accommodate panels of different thicknesses. Thus, a joystick designed for a thin panel will not project sufficiently above a ¾" panel to be able to obtain the desired "feel" of the joystick handle. On the other hand, a joystick designed for a ¾" panel will project too far. As a result, the shaft will pivot too much and, therefore, feel uncomfortable to the player.

SUMMARY OF THE INVENTION

It is therefore an important object of the present invention to provide a joystick which is easily modifiable to be usable on panels of two different thicknesses.

In summary there is provided a joystick adapted to be mounted on a first panel of a given thickness or a second panel of greater thickness, the joystick comprising a frame for mounting beneath and to a selected panel, a shaft extending through the frame and having a larger-diameter first shaft portion and a smaller-diameter second shaft portion, each of the shaft portions having a free end, means pivotally mounting the second shaft portion to the frame, a handle on the free end of the first shaft portion, actuating means on the second shaft portion, switch means mounted on the frame and being positioned and arranged to be selectively engaged by the actuating means as the shaft is pivoted, a bushing having an inside diameter slightly greater than the diameter of the second shaft portion, the bushing being located o the second shaft portion adjacent to the free end thereof when the joystick is mounted on a first panel, the bushing being located on the second shaft portion at the other end thereof when the joystick is mounted on a second panel.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
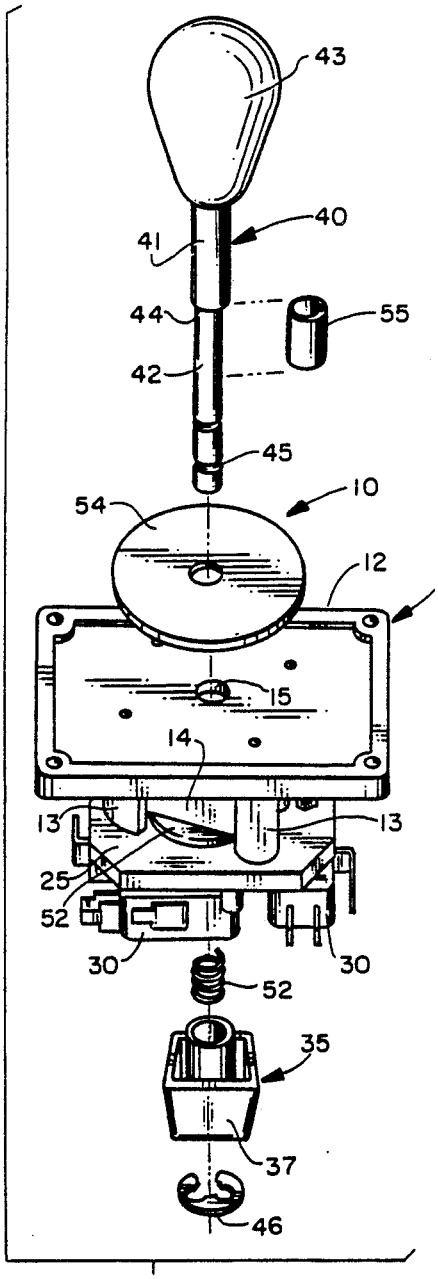
FIG. 1 is, an exploded view of a joystick incorporating the features of the present invention.
Figure 2:
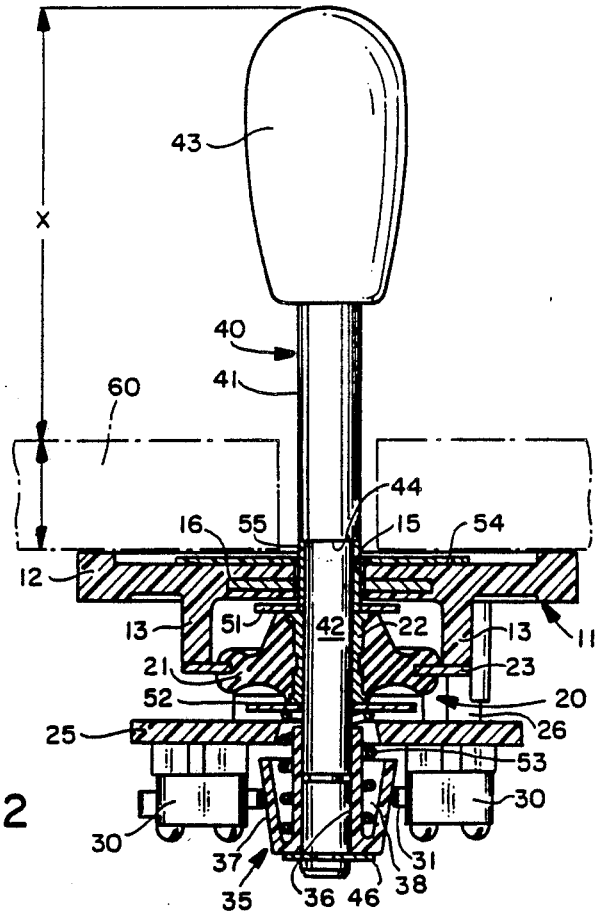
FIG. 2 is a view in vertical section of the joystick of FIG. 1 mounted on a ¾" panel.

Referring now to FIGS. 1 and 2 of the drawings, there is illustrated a joystick 10 constructed in accordance with and embodying the features of the present invention. The joystick 10 includes a frame 11 which is of unitary, one-piece construction and is preferably formed of molded plastic. The frame 11 includes a generally flat, square plate 12, a set of four depending posts 13 and a set of four walls 14 defining a generally square chamber. The posts 13 depend further than the walls 14 and are respectively located generally at the intersection thereof. Plate 12 has a circular opening 15 located centrally thereof. Embedded in plate 12 is a metal washer 16 having a hole helping to define opening 15.

Disposed within the walls 14 is a pivot mechanism 20, which includes a round, flexible diaphragm 21, a journal 22 extending through such diaphragm and a square mounting washer 23 securely attached to the periphery of diaphragm 21. Mounting washer 23 is disposed against walls 14. A plastic plate 25 has four depending lugs 26 respectively laterally aligned with posts 13 and disposed against mounting washer 23. Plate 25 is attached by screws 27 to posts 13, thereby firmly retaining pivot mechanism 20 on frame 11.

A set of four microswitches 30 is attached to the mounting plate 25 located respectively at 0°, 90°, 180° and 270°. Each switch 30 includes a button 31 which is outwardly biased, but can be depressed to close associated switch 30. Although four, normally open microswitches are depicted, it is to be understood that more or fewer can be employed, they can be normally closed and other kinds of switches, such as leaf-spring switches, can be used instead.

Joystick 10 further comprises an actuator 35, which, in the embodiment depicted, includes a cylindrical inner portion 36 and a pyramidal outer portion 37, and an annulus 38 being defined therebetween.

Joystick 10 further comprises a shaft 40 extending through frame 11 and having a larger-diameter first shaft portion 41 and a smaller-diameter second shaft portion 42. In an operating embodiment, the portion 41 was slightly longer than the portion 42. The outer end of portion 41 is knurled (not shown) and frictionally receives a handle 43. The juncture of portions 41 and 42 is a shoulder 44. Portion 42 extends through journal 22 in pivot mechanism 20 and also extends through the inner portion 36 of actuator 35. Therefore, actuator 35 is a separate element slid onto portion 42 of shaft 40. Near the free end of shaft portion 42 is a groove 45 which receives an E-ring 46 which constitutes a retaining means. A pair of washers 51 and 52 are located on opposite sides of journal 22. A spring 53 is located within annulus 38 of actuator 35, the other end of such spring bearing against washer 52.

A sleeve 55 has an inner diameter slightly greater than the diameter of shaft portion 42 and an outer diameter preferably the same as shaft portion 41. Sleeve 55 is located on shaft portion 42 between shoulder 44 and washer 51.

Spring 53 biases the free end of shaft portion 42 away from pivot mechanism 20.

In operation, diaphragm 21 accommodates pivotal movement of shaft 40. Diaphragm 21, therefore, constitutes a flexible hinge for shaft 40. The extent of movement is limited by the diameter of opening 15 in support plate 12. Opening 15 is dimensioned to permit shaft 40 to pivot far enough in each direction to bring actuator 35 into engagement with button 31 of any of microswitches 30. If shaft 40 is pivoted in one of the directions of 0°, 90°, 180° or 270°, the corresponding one of the microswitches 30 will be closed. If shaft is pivoted in one of the directions 45°, 135°, 225° or 315°, actuator 35 will simultaneously close two adjacent ones of switches 30. Thus, the joystick provides "eight-way" control.

A washer 54 loosely carried on plate 12 to prevent dust and liquids from falling through opening 15 and into the rest of the joystick mechanism. Washer 54 freely slides on plate 12 as shaft 40 is pivoted.

Referring to FIG. 2, joystick 10 is beneath and is attached to the undersurface of a panel 60 by means of screws (not shown) passing through the holes in the corners of plate 12. Many video games use a panel 60 which is ¾" thick. In a particular embodiment, the dimension X from the end of handle 43 to panel 60 was approximately 3".

Figure 3:
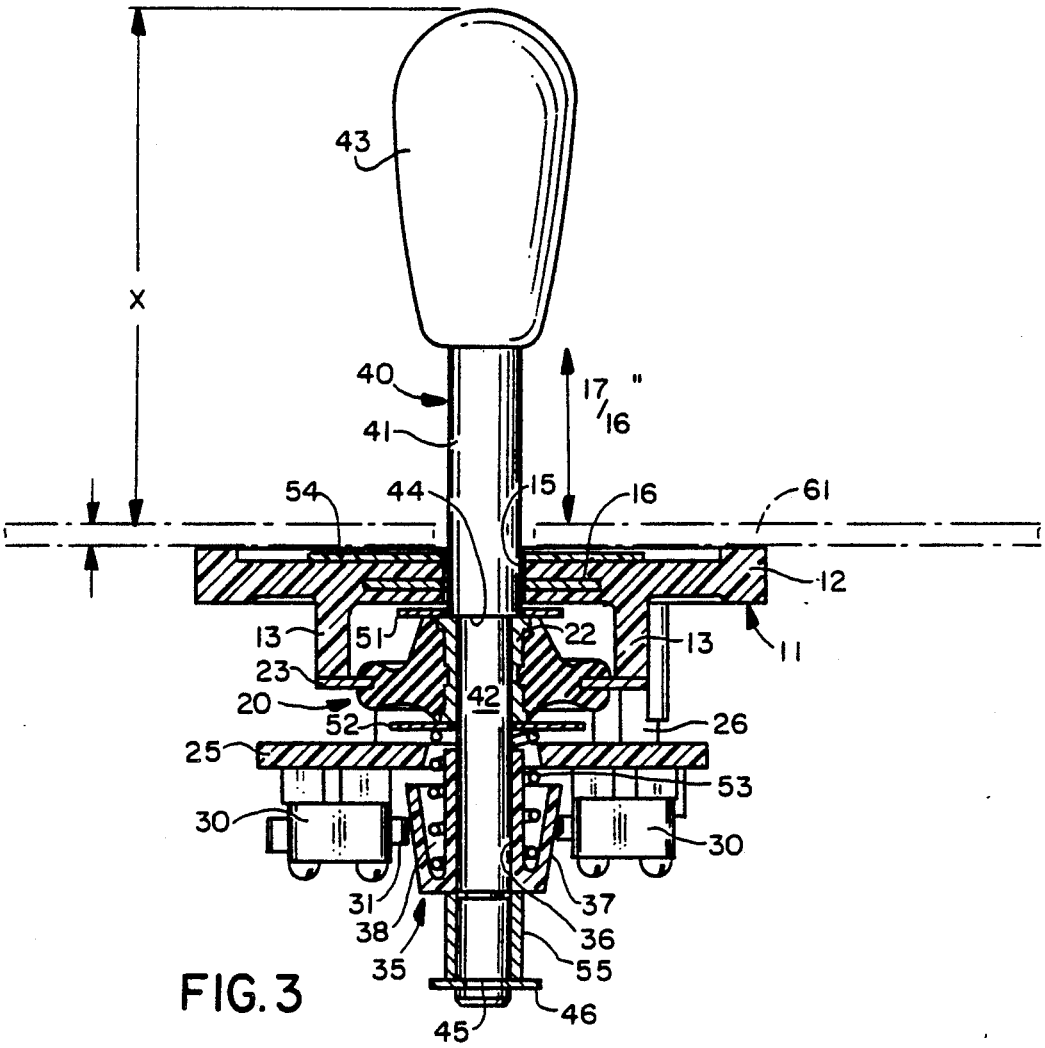
FIG. 3 is a view of the joystick like FIG. 2, but mounted on a ⅛" panel.
Figure 4:
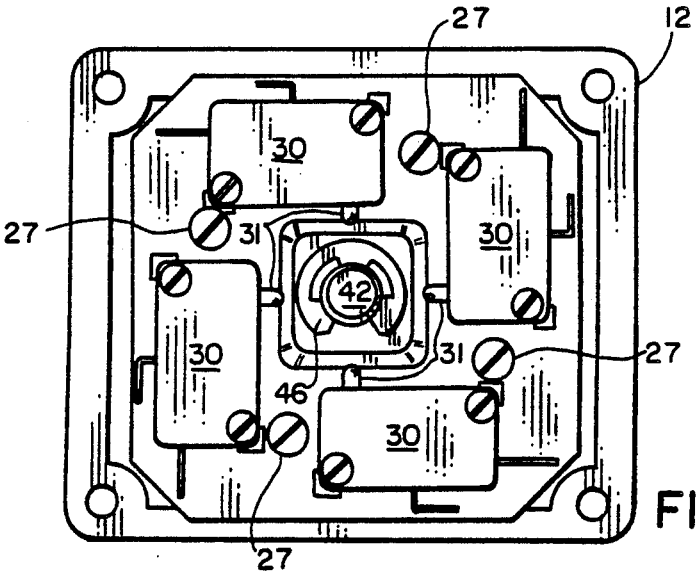
FIG. 4 is a bottom plan view of FIGS. 2 and 3.

Thus, if joystick 10 is used with a ⅛" panel, handle 43 will project above such panel a distance greater than distance X. Following through on the example, the distance X would be approximately 3-⅝". That will give the player a different "feel" of the joystick. The construction described, however, enables modification of joystick 10 so that distance X stays fairly constant even with a thinner panel. Referring to FIG. 3, joystick 10 is mounted on a panel 61 of ⅛" in thickness. Before mounting the joystick, it is modified as follows. It is disassembled and sleeve 55 is placed at the other end of shaft portion 42, that is, between actuator 35 and E-ring 46. In this condition, journal 22 is disposed against shoulder 44. The distance X in FIG. 3 is about 3-⅛". Thus, with such modification of joystick 10 the distance X is only slightly different with the two panels. As far as the player is concerned, the joystick has the same "feel" irrespective of the thickness of the panel on the video game he is playing.

In an operative embodiment, sleeve 55 had a length of ½". A sleeve of different length can be used to modify the "feel" as desired.

What has been described therefor is an improved joystick which can be used on video-game panels of two different widths. It gives the same "feel" to the player.

What is claimed is:

1. A joystick adapted to be mounted on a first panel of a given thickness or a second panel of greater thickness, said joystick comprising a frame for mounting beneath and to a selected panel, a shaft extending through said frame and having a larger-diameter first shaft portion and a smaller-diameter second shaft portion, each of said shaft portions having a free end, means pivotally mounting said second shaft portion to said frame, a handle on the free end of said first shaft portion, actuating means on said second shaft portion, switch means mounted on said frame and being positioned and arranged to be selectively engaged by said actuating means as said shaft is pivoted, a bushing having an inside diameter slightly greater than the diameter of said second shaft portion, said bushing being located on said second shaft portion adjacent to the free end thereof when said joystick is mounted on a first panel, said bushing being located on said second shaft portion at the other end thereof when said joystick is mounted on a second panel.

2. The joystick of claim 1, wherein the length of said bushing is slightly less than the difference in thicknesses of the first and second panels.

3. The joystick of claim 1, and further comprising retaining means on said second shaft portion and disposed against said bushing when located adjacent to the free end thereof.

4. The joystick of claim 1, wherein said actuating means is a separate element slid onto said second shaft portion.

5. The joystick of claim 1, wherein said shaft further includes a shoulder at the intersection of said first and second shaft portions, said pivotal mounting means including a flexible hinge and a central journal, said shoulder resting on said journal.

6. The joystick of claim 1, wherein said switch means includes four separate switches respectively located 90° apart.

7. The joystick of claim 1, wherein said actuating means includes inner and outer portions defining an annulus therebetween, said second shaft portion extending through said inner portion, said outer portion selectively engaging said switch means.

8. The joystick of claim 7, and further comprising spring means in said annulus urging the free end of said second shaft portion away from said frame.

9. A joystick adapted to be mounted on a first panel of a given thickness or a second panel of greater thickness, said joystick comprising a frame for mounting beneath and to a selected panel, a shaft extending through said frame and having a larger-diameter means and a smaller-diameter means, each of said means having a free end, said shaft being pivotally mounted on said frame, a handle on said larger-diameter means, actuating means on said smaller-diameter means, switch means mounted on said frame and being positioned and arranged to be selectively engraved by said actuating means as said shaft is pivoted, and a bushing having an inside diameter slightly greater than the diameter of said smaller-diameter means and less than the diameter of said larger-diameter means, said bushing being located on said smaller-diameter means near the free end thereof when said joystick is mounted on a first panel, said bushing being located on said shaft adjacent to said larger-diameter means when said joystick is mounted on a second panel.

10. The joystick of claim 9, wherein said smaller-diameter said larger-diameter means are made of metal.

11. The joystick of claim 9, wherein said handle is separate from and applied to said larger-diameter means.

12. The joystick of claim 9, wherein said actuating means is a separate element on said shaft.

13. The joystick of claim 12, and further comprising retaining means on said shaft, said bushing being positioned between said actuating means and said retaining means.

14. The joystick of claim 9, wherein said actuating means includes inner and outer portions defining an annulus therebetween, said shaft extending through said inner portion, said outer portion selectively engaging said switch means.

* * * * *

UNITED STATES PATENT AND TRADEMARK OFFICE

CERTIFICATE OF CORRECTION

PATENT NO. : 5,068,498

DATED : November 26, 1991

INVENTOR(S) : Raul R. Engel

It is certified that error appears in the above-identified patent and that said Letters Patent is hereby corrected as shown below:

Column 4, line 53, "said larger-diameter means are made of metal" should read --means and said larger-diameter means are of one-piece construction--.

Signed and Sealed this

Thirtieth Day of March, 1993

*Attest:*

STEPHEN G. KUNIN

*Attesting Officer*

*Acting Commissioner of Patents and Trademarks*